US008237089B2

(12) United States Patent
Legrain et al.

(10) Patent No.: US 8,237,089 B2
(45) Date of Patent: Aug. 7, 2012

(54) HAIRDRESSING APPARATUS

(75) Inventors: Marc Legrain, Civrieux en Dombes (FR); Bénédicte Simond, Marcellaz-Albanais (FR)

(73) Assignee: SEB S.A., Ecully (FR)

( * ) Notice: Subject to any disclaimer, the term of this patent is extended or adjusted under 35 U.S.C. 154(b) by 271 days.

(21) Appl. No.: 12/664,230

(22) PCT Filed: Jun. 6, 2008

(86) PCT No.: PCT/FR2008/000770

§ 371 (c)(1),
(2), (4) Date: Dec. 11, 2009

(87) PCT Pub. No.: WO2009/004191

PCT Pub. Date: Jan. 8, 2009

(65) Prior Publication Data

US 2010/0170883 A1 Jul. 8, 2010

(30) Foreign Application Priority Data

Jun. 11, 2007 (FR) ..... 07 04145

(51) Int. Cl.

| | |
|---|---|
| ***A45D 1/04*** | (2006.01) |
| ***A45D 1/08*** | (2006.01) |
| ***A45D 1/20*** | (2006.01) |
| ***A45D 2/36*** | (2006.01) |

(52) U.S. Cl. ..... 219/225; 132/232; 132/234; 132/238; 132/269

(58) Field of Classification Search ..... 219/244
See application file for complete search history.

(56) References Cited

U.S. PATENT DOCUMENTS

| | | | | |
|---|---|---|---|---|
| 1,854,050 | A * | 4/1932 | Maass | 132/263 |
| 1,909,894 | A * | 5/1933 | Protzky | 132/224 |
| 4,342,323 | A | 8/1982 | Rick et al. | |
| 4,365,140 | A | 12/1982 | Bast et al. | |
| 4,479,047 | A * | 10/1984 | Khaja et al. | 219/225 |
| 4,829,156 | A * | 5/1989 | Thompson | 219/225 |
| 5,119,847 | A * | 6/1992 | Powell et al. | 132/226 |
| 5,649,555 | A * | 7/1997 | Harris | 132/238 |
| 5,832,939 | A * | 11/1998 | Nathe | 132/225 |
| D541,472 | S * | 4/2007 | Kuchler et al. | D28/35 |
| 2006/0237418 | A1 | 10/2006 | Bousfield | |
| 2007/0163614 | A1 | 7/2007 | Ikesaki | |
| 2007/0199574 | A1 * | 8/2007 | Ragosta et al. | 132/238 |
| 2010/0212684 | A1 * | 8/2010 | Han | 132/232 |

FOREIGN PATENT DOCUMENTS

| | | | |
|---|---|---|---|
| EP | 0619088 | A | 10/1994 |
| EP | 1733642 | A | 12/2006 |
| GB | 191112191 | A | 0/1911 |
| GB | 2082908 | A | 3/1982 |
| WO | 2005023046 | A | 3/2005 |
| WO | WO 2008017478 | A2 * | 2/2008 |

OTHER PUBLICATIONS

WO 2008/017478 A2, Hottenrott et al, Feb. 14, 2008, partial machine translation.*

* cited by examiner

*Primary Examiner* — Joseph M Pelham
(74) *Attorney, Agent, or Firm* — Browdy and Neimark, PLLC

(57) ABSTRACT

Hairstyling appliance comprising a grasping means (2), a body (3) for winding a lock of hair around its longitudinal axis, the winding body containing an electric heating element and comprising an external hair-winding surface (5) extending along substantially its entire length, a clip (7) for hooking the lock of hair onto the winding body (3) and an electric motor for driving the winding body in rotation around its longitudinal axis. According to the invention, it includes at least one heating plate (9, 10) disposed facing the external surface (5) of the winding body (3), which plate is movably mounted with respect to the winding body so as to exert pressure on the lock of hair.

18 Claims, 4 Drawing Sheets

Figure 1:
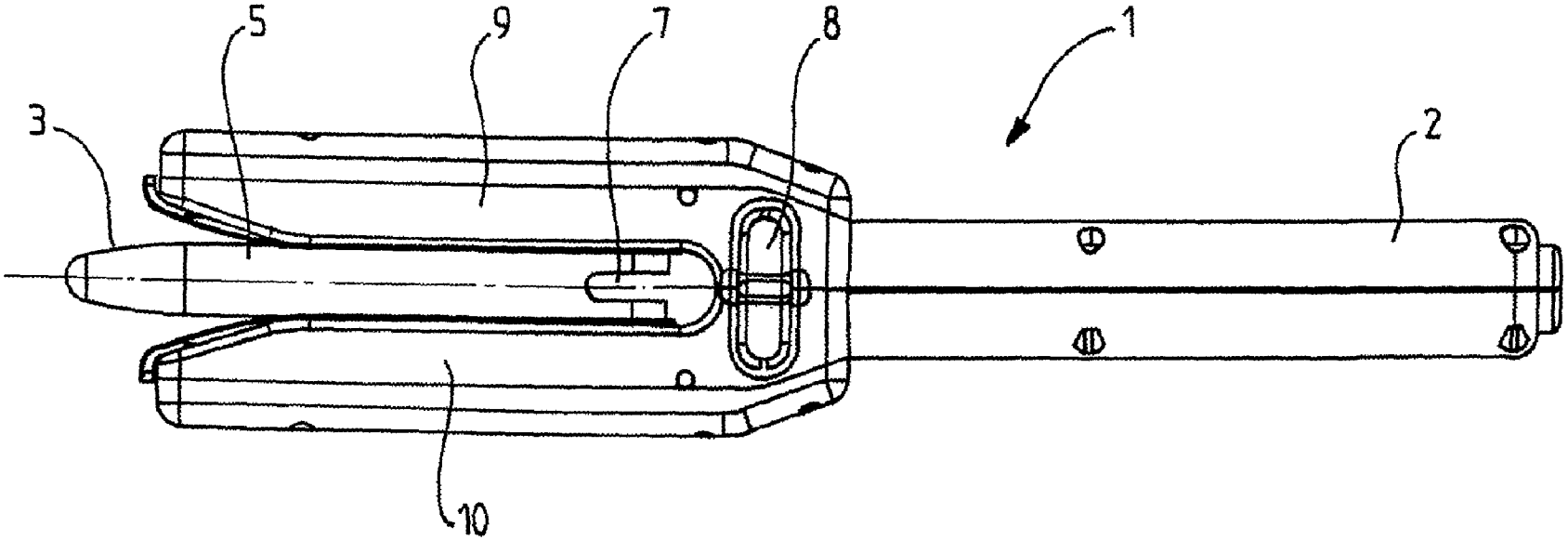

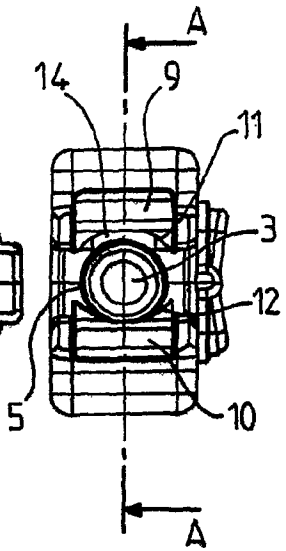
FIG.2a
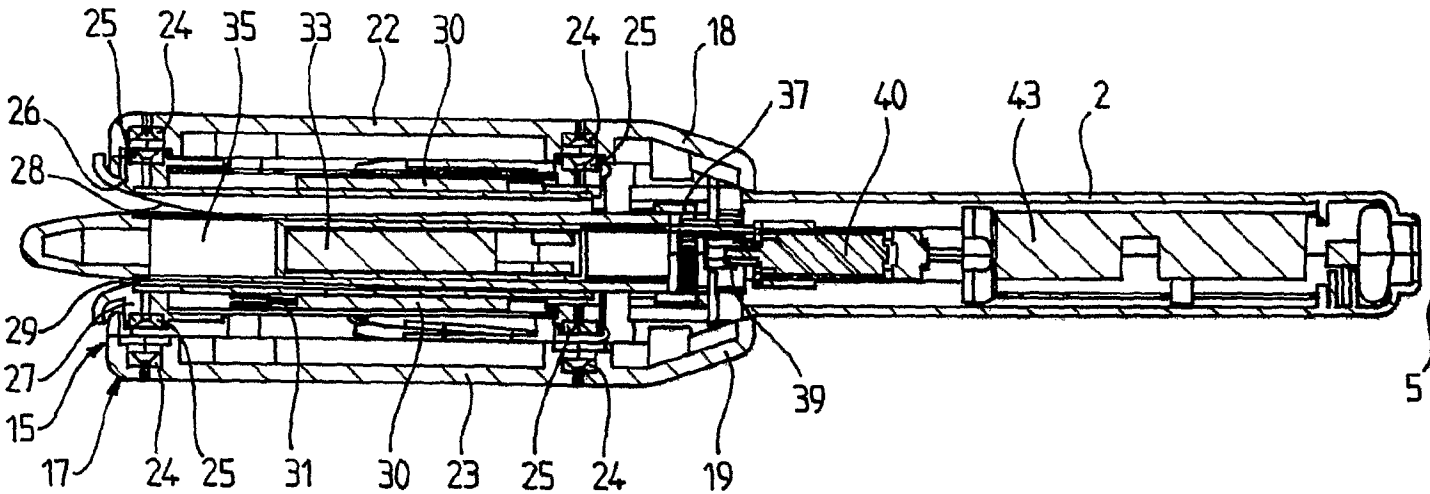
FIG.2b Section A-A

HAIRDRESSING APPARATUS

The present invention relates to an appliance for styling or shaping the hair, more particularly of the hair-curling or crimping iron type, comprising a housing joined to at least one rotating heating body for heat-shaping the hair.

Most hair-shaping appliances, for example crimping or curling irons, comprise a handle supporting a heating mandrel and a spring-mounted pressure clip for bringing the hair into contact with the mandrel, particularly by moving from an open position allowing the hair to be inserted to a closed position for placing it in contact with the heating mandrel. The movement from the open position to the closed one is produced manually by pressing an opening lever of the pressure clip. In use, the mandrel is heated and the end of a lock of hair is grasped between the pressure clip and the mandrel. Manually rotating the curling iron makes it possible to wind the rest of the lock of hair around the mandrel. The heat modifies the texture of the hair and allows it to assume the shape of the mandrel, forming a curl. The curl is then unwound to remove it from the mandrel. Among the problems encountered in the use of such an appliance is that of winding a lock of hair around the mandrel. In fact, aside from the fact that the winding is difficult to do by hand and, moreover, has a tendency to twist the power cable, it has also been observed that if the hair has poor contact with the mandrel, it does not form a lasting curl.

The document U.S. Pat. No. 4,829,156 proposes a solution for a more uniform and more comfortable winding of a lock of hair around a heating mandrel by suggesting that the mandrel be driven in rotation by an electric motor. In operation, the end of a lock of hair is grasped by opening a clamp pivotably mounted around an articulation of the mandrel; then, by actuating a switch, the mandrel is made to rotate, thus allowing the lock of hair to be wound onto the mandrel automatically.

The problem that is often encountered with such an appliance is that it requires a long treatment time which, moreover, increases with the thickness of the winding, since the energy is only transferred to the hair from inside the winding, i.e. from the heating mandrel.

The document US 2006/0237418 describes an appliance similar to the above, but wherein the holding clamp that retains the lock of hair prior to its being wound can be heated. This document has the same drawbacks as the previous one, the wound lock of hair being heated only from the inside, in contact with the mandrel and the clamp, the winding being performed around the clamp when it is in the closed position on the mandrel.

A solution was proposed in the document DE 195 27 111, which describes a curling iron comprising a cylindrical central body around which a lock of hair is wound, the appliance being completed by two pivoting jaws disposed on either side of the mandrel. The central body communicates at one of its ends with a housing that blows hot air into the body, from whence it is distributed in the direction of the hair through air outlets formed along its length. In operation, the hair is manually wound around the central body, which is equipped with bristles for retaining the hair. At the end of the winding, the jaws are closed over the central body, then hot air is circulated into the latter. The hair is thus dried with a supply of hot air from inside the mandrel, the forced air then being sent back by the lateral jaws in the direction of the hair. While this certainly makes it possible to reduce the drying time of a lock of hair wound around the central body, this appliance is limited by the difficulty and the unevenness of the manual winding around the central body, with open jaws further interfering with the operation, and by the low heat supply provided by the flow of hot air, which heat supply is even lower on the outer part of the winding, which it reaches indirectly by being sent back through the inner wall of the lateral jaws. It is also noted that, due to the lack of contact between the lock of hair to be treated and the peripheral jaws, the heat transfer is very poor.

The object of the present invention is to obviate the aforementioned drawbacks and to propose a hairstyling appliance that makes it possible to efficiently wind a lock of hair and, at the same time, to quickly and effectively supply it with the energy required for proper treatment.

Another object of the invention is a hairstyling appliance capable of improving the heat transfer with a lock of hair to be treated.

Another object of the invention is a hairstyling appliance that provides good ergonomics and is comfortable to use, while being reliable in operation.

Another object of the invention is a hairstyling appliance of simplified structure that is compact and can be mass-produced at low cost.

These objects are achieved with a hairstyling appliance comprising a grasping means, a body for winding a lock of hair around its longitudinal axis, the winding body containing an electric heating element and comprising an external hair-winding surface extending along substantially its entire length, a clip for hooking the lock of hair onto the winding body, and an electric motor for driving the winding body in rotation around its longitudinal axis, due to the fact that it includes at least one heating plate disposed facing the external surface of the winding body, which plate is movably mounted with respect to the winding body so as to exert pressure on the lock of hair.

The hairstyling appliance of the invention comprises, first of all, a motorized heating winding body, capable of automatically winding a lock of hair from its end to the root of the hair. The end of the lock of hair is held on the winding body by a hooking clip, the driving of the winding body in rotation around its longitudinal axis making it possible to automatically wind the lock of hair onto its external winding surface. Thus, such automatic winding makes it possible to reduce the winding time and make the operation easy for the user, the lock of hair thus being able to quickly cover the external surface of the winding body. Moreover, using an effective hooking means and adapting the rotation speed of the motor to the dimensions of the winding body, or even to the type of hair to be treated, produces an effective winding for an optimal and uniform tensioning of the wound lock of hair.

According to the invention, the external surface of the winding body cooperates with the internal surface of at least one opposing heating plate movably mounted with respect to the winding body so as to exert pressure on the lock of hair as it is wound, or when it has already been wound around the latter. This pressure, exerted by a heating plate that is applied to the winding body, makes it possible to heat the outer part of the wound lock of hair, in addition to the heating of its inner part performed by the heating winding body. Preferably, the internal surface of the heating plate has a length comparable to that of the external surface of the winding body (or at least equal to half of it) in order to be able to treat long locks of hair evenly.

In fact, it was observed during tests performed in the laboratory that the determining factors for obtaining a well-formed and long-lasting curl were good winding tension, the quality of the energy transfer, which essentially depends on the quality of the lock of hair's contact with the heating element, and the energy transmitted to the hair.

The appliance of the invention therefore includes a hooking clip that is separate from the heating pressure plate. This makes it possible to firmly grasp the lock of hair by its end and to wind it around the cylindrical body so as to tension it effectively. Thus, supplying heat to a properly tensioned lock of hair while maintaining it in contact with two heating parts that are sandwiching it produces a well formed curl that holds its shape well over time, quickly, effectively and effortlessly.

Preferably, the appliance includes two heating plates disposed on either side of the longitudinal axis of the winding body.

With such an arrangement of the central winding body and the external heating plates, it is possible to supply energy to the lock of hair at various points of the winding, which makes it possible, at the same temperature, to reduce the treatment time of the lock of hair. In an advantageous variant of the invention, the median plane passing through the longitudinal axis of the winding body contains the longitudinal axes of the two heating plates.

Advantageously, the internal surface of the heating plates has a concave shape.

Such a hollowed shape makes it possible to better adapt to a lock of hair wound on a rotating central body, since the contact with the wound hair can thus be obtained on contact lines, or even on a contact surface. With heating plates exerting a constant pressure force on both sides of the winding body, along its useful winding length, a constant supply of energy is transmitted into all areas of the lock of hair treated.

Preferably, the winding body has a shape generated by rotation, and as seen in the same cross-section of the appliance, the radius of curvature of the heating plate is equal to or larger than that of the winding body.

A radius of the heating plate equal to that of the winding body allows the heating plate to closely mold to the periphery of the winding body, while a larger radius allows it to be adapted to locks of hair of substantial thickness.

Advantageously, each heating plate includes an electric heating element and means for regulating its temperature.

This allows each plate to be controlled individually by control means of the appliance.

Preferably, the appliance comprises means for controlling the temperature of the heating element of the winding body and means for controlling the temperature of the heating elements of the heating plates.

This makes it possible to independently control the temperature of the winding body and that of the heating plates, for greater flexibility and adaptability to various treatment operations (curl styling with or without the use of liquid, etc.), and to various types of hair.

In one advantageous embodiment of the invention, the heating plates are mounted so as to be capable of moving radially inside a frame immovably mounted on the main body of the appliance.

In a first variant of the invention, the heating plates are pivotably mounted around articulations belonging to the main body of the appliance, preferably under the thrust of a spring. This has the advantage of an easier introduction of the lock of hair on the winding body, but the drawback of having to manipulate the plates manually when either opening or closing them.

It is nevertheless preferred to mount the heating plates on a frame which is itself immovably mounted with respect to the main body of the appliance, the plates nonetheless being radially movable in the direction of the winding body by a suitable pressure-exerting means, which may be an elastic means (spring, deformable element, etc.), by a magnetic means, or by using the pressure of a fluid delivered by a pump, etc. Thus, each heating plate is equipped with a chamfer which facilitates the insertion of the hair between itself and the free end of the winding body. This solution has the advantage of making it possible to exert constant uniform pressure along the entire length of the wound lock of hair, while relieving the user of the need to maintain manual contact.

Preferably, said heating plates are float mounted using means for suspending them with respect to said frame.

Float mounting of a heated plate with respect to the fixed frame is understood to mean a mounting with play and the ability to move in at least one direction when the heating plate is subjected to a force. Such a float mounting allows the heating plate one or more degrees of freedom. Such a float mounting of the heating plate can be achieved, for example, by joining it to its support with at least one pivot-type or ball-type joint, which allows it to move in rotation on one or more axes, or with a slip-type joint which allows it to move in translation.

Such an appliance is easy and intuitive to use, thus making it possible to perform an effortless treatment with greater freedom for the person using it, the system being capable of absorbing the varying thickness of the lock of hair inserted between a floating heating plate and a fixed winding body. This solution thus makes it possible to transmit all of the heat to the lock of hair while adapting to its thickness, which can vary along the length of the winding body.

Furthermore, this solution with a heating plate normally maintained in contact with the winding body by the winding means makes it possible to perform a pre-straightening of the lock of hair as it is wound on the winding body. This guarantees a better appearance and a better hold of the curl thus formed.

Advantageously, the suspension means of each plate comprise at least one pair of opposing magnets mounted in phase with each other.

It would, of course, have been possible to use elastic suspension means, for example springs. However, the magnetic suspension means are preferred since they allow the part subject to displacement by the magnetic field to very precisely adapt to the slightest thickness of a lock of hair inserted between the opposing heating and supporting parts. This adaptation takes place without the slightest mechanical loss due to friction, obstruction, the manufacturing tolerances of the components (the geometric structural flaws being compensated by this float mounting with magnets), etc.

When a pair of magnets mounted in phase is used, the magnetic field is enclosed inside the housing of the appliance, without influencing the treatment zone that comes into contact with the hair. Moreover, the magnets thus disposed are at a distance from the treatment surfaces, hence less subject to the temperature, which improves their service life.

Preferably, the appliance comprises means for adjusting the distance between a heating plate and its support.

This makes it possible to vary the play between the treatment means in order to adapt it to various winding thicknesses, due in particular to variations in the length of the hair.

Advantageously, the appliance comprises means for adjusting the force of the suspension means.

This makes it possible to better adapt the pressure applied to the lock of hair by the heating plate as a function of the type of hair (thin, thick, fragile, frizzy, etc.).

Preferably, the winding body has a conical shape from a base that joins it to the main body to an opposite end, the radius of the base being larger than that of the end.

Such a conically shaped winding body makes it easy to unwind the lock of hair at the end of the treatment. Moreover, such a conical shape of the external surface of the winding body allows a more even winding of the lock of hair because, during the rotation, the lock of hair has a tendency to follow the axial component of the force applied, and hence to spread more evenly along the length of the winding body.

Advantageously, the winding body is driven in rotation by a geared motor at a speed between 5 and 30 rpm.

It was observed during tests performed in the laboratory that this range of speeds makes it possible to produce most types of curls of various diameters, while ensuring a good tensioning of the hair during the winding. For example, the diameters of the winding body are between 10 and 40 mm.

Preferably, the appliance of the invention comprises means for limiting the torque of the motor.

This makes it possible to prevent excess tension from being applied to the hair, either at the end of the winding or when a problem occurs during the winding.

Advantageously, said means for limiting the torque comprise a microprocessor capable of monitoring the current absorbed by the geared motor and of cutting off its power supply if a threshold limit is exceeded.

This represents a solution that is simple and reliable in operation and is easily incorporated into a compact, lightweight device, making it possible to avoid the use of a bulkier gearing system.

Preferably, the appliance of the invention comprises means for controlling the direction of rotation of the winding body.

By actuating these control means at the start of operation, the direction of rotation, and hence the winding direction of the hair, is chosen so as to obtain either an outward curl or an inward curl. By changing the direction of rotation of the motor at the end of the treatment, the previously formed curl is unwound.

Advantageously, the winding body comprises, on the inside, a heating element immovably mounted to the main body of the appliance, and on the outside, a tube rotatably mounted around the longitudinal axis of the winding body.

This solution makes it possible to have a rotating heating winding body, while avoiding the use of rotating contacts, for a simpler and more robust solution, the winding body thus being better able to withstand the pressure forces of the heating plates.

Preferably, the external surface of the winding body and the internal surface of the heating plates is polished or covered with a coating with a low friction coefficient.

Such polished surfaces guarantee good sliding of the hair during the winding and also during the unwinding of the lock of hair. The surfaces can be produced by mechanical polishing or electropolishing. The coating used can be PTFE, a ceramic coating, a chromium plating, an anodic oxidation, etc.

The invention will be more clearly understood through the study of the embodiments presented as nonlimiting examples and illustrated in the attached figures, in which:

FIG. 1 is a side view of the appliance according to a preferred embodiment of the invention comprising two heating plates shown in the working position;

FIG. 2*a* is a side view of the appliance of FIG. 1, one of the heating plates being shown in the working position, and the other in the resting position;

FIG. 2*b* is a longitudinal sectional view obtained in the plane A-A of FIG. 2*a;*

Figure 3:
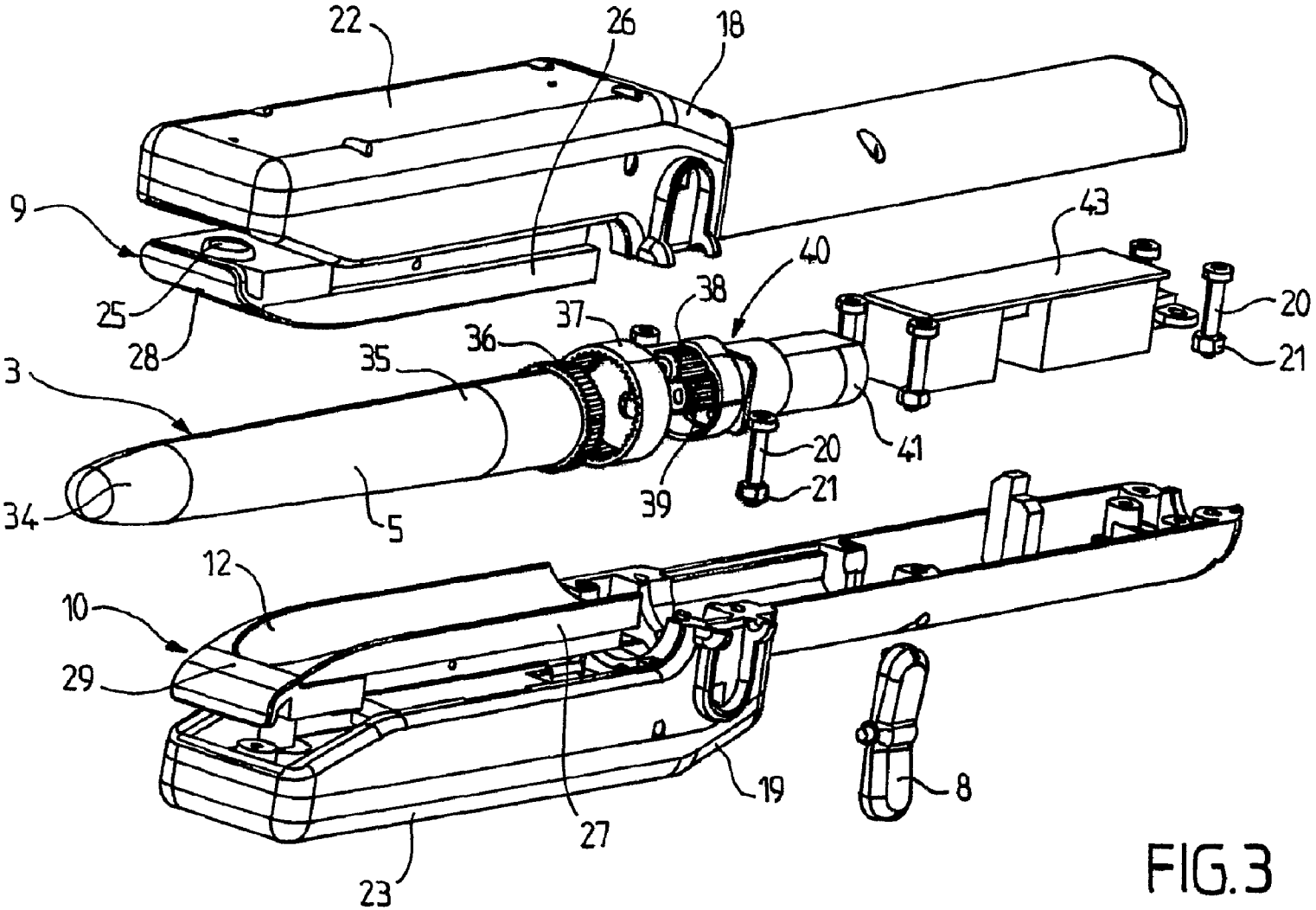
Figure 4A:
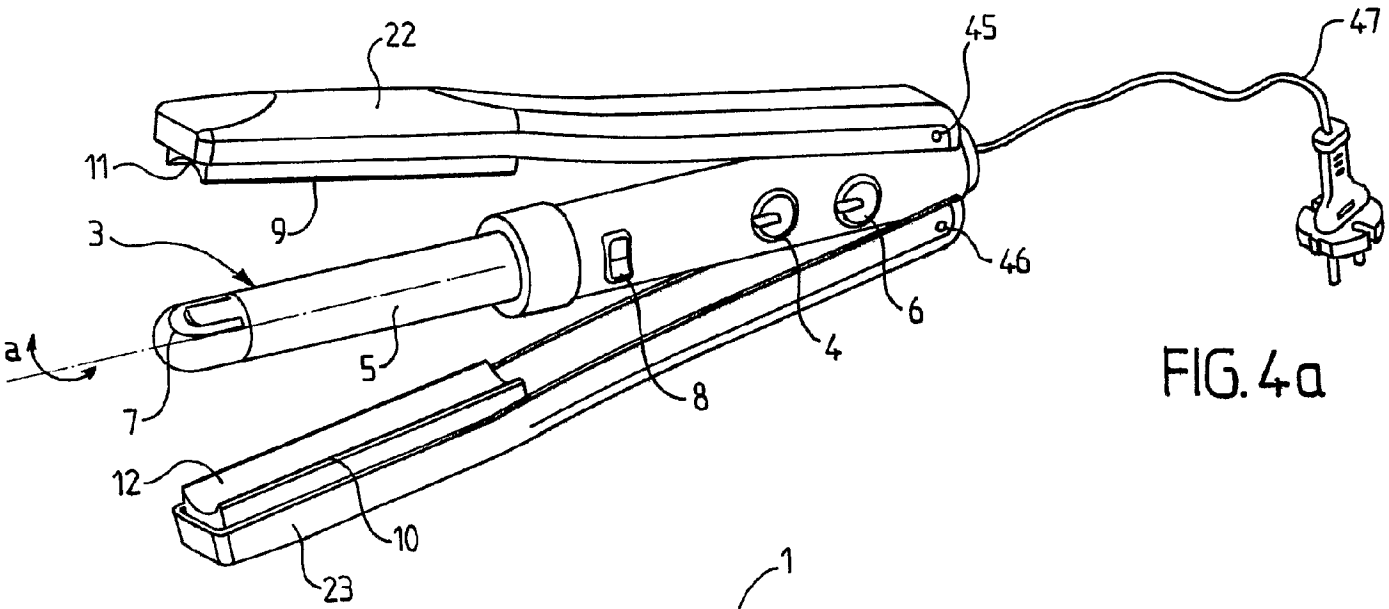
Figure 4B:
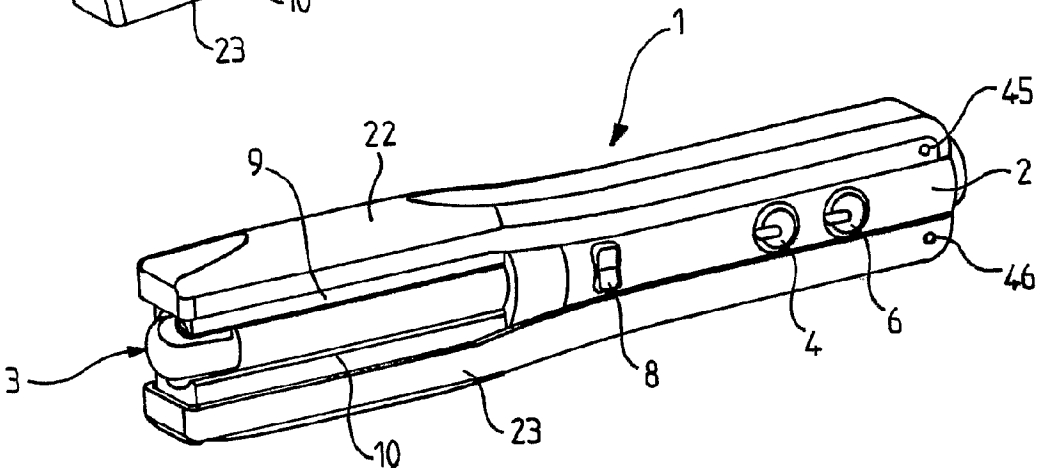

FIG. 3 is an exploded perspective view of the appliance of FIG. 1;

FIG. 4*a* is a perspective view of an appliance obtained according to a variant of the invention, the heating plates being shown in the open position, and FIG. 4*b* is a perspective view of the appliance of FIG. 4*a*, the heating plates being closed on the winding body.

The hairstyling device illustrated in the attached figures is a curling iron comprising a main body 1 whose rear part forms a grasping means or handle 2 and whose front part comprises the hair-shaping means. The hair-shaping means include a heating winding body 3 driven in rotation around its longitudinal axis by an electric motor controlled by a button 8. The winding body 3 has an external surface 5 for winding a lock of hair starting at its end, which is held on the winding body by a clip 7.

According to the invention, the winding body 3 cooperates with at least one opposing heating plate which is movable so as to allow a lock of hair to be inserted between the two during its automatic winding by the winding body 3 starting at an end held by the clip 7, and also so as to sandwich it for the purpose of shaping it. In the examples illustrated in the figures, two heating plates 9, 10 are mounted on either side of the winding body 3, so as to be movable with respect to the latter in order to allow the lock of hair to be inserted and wound around the winding body 3, the lock of hair simultaneously coming into contact with the external surface 5 of the winding body 3 and with the internal surfaces 11, 12 of the heating plates 9, 10.

Referring to FIGS. 2*a* and 2*b*, the upper heating plate 9 is shown in its working position, in which it is located at a distance 14 corresponding to the thickness of the lock of hair (not shown in the drawings) inserted between the external surface 5 of the winding body 3 and the internal surface 11 of the heating plate 9. The lower heating plate 10 is shown in the resting or neutral position, i.e. before a lock of hair has been inserted between its internal surface 12 and the external surface 5 of the winding body 3.

According to an advantageous aspect of the invention, each heating plate 9, 10 is float mounted using suspension means 15 in a frame 17 joined or attached to the handle 2 of the main body 1 of the appliance. In the example illustrated in the figures, the frame 17 is formed in the front part by two symmetrical shells 18, 19, their rear part forming the handle 2. The shells 18, 19 are held together using for example mounting means comprising bolts 20 and nuts 21 (FIG. 3). The frame 17 as seen in longitudinal section is generally U-shaped, comprising two parallel arms 22 and 23 disposed on either side of the longitudinal axis of the winding body 3.

Each arm 22, 23 has a U-shaped cross-section that floatingly supports a heating plate 9, 10. In the example illustrated in the figures, the float mounting of the heating plates 9, 10 in the frame 17 is obtained using a magnetic field with several pairs of permanent magnets mounted in phase. Thus, the upper arm 22 of the frame 17 includes two permanent magnets 24 immovably mounted in cavities formed on the internal surface of the arm 22. The magnets 24 have a cylindrical shape and are disposed so that their axis is contained in the median plane of the arm 22. The magnets 24 are oriented with their north pole toward the outside. The upper heating plate 9 associated with the arm 22 comprises two permanent magnets 25 immovably mounted in cavities formed on the upper surface of its body 26. The magnets 25 have the same shape and the same dimensions as the opposing magnets 24 and are also disposed so that their axis is contained in the median plane of the body 26 of the plate 9. The magnets 24 are oriented with their north pole toward the outside, facing the magnets 25. Likewise, the lower arm 23 of the frame 17 includes two permanent magnets 24 immovably mounted in cavities formed on the internal surface of the arm 23, the cylindrical magnets 24 being disposed with their axis contained in the median plane of the arm 23 and oriented with their north pole toward the outside. The heating plate 10 associated with the arm 23 includes two permanent magnets 25 immovably mounted in cavities formed on the upper surface of its body 27, which magnets have the same shape and the same dimensions as the magnets 24 and are also disposed so that their axis is contained in the median plane of the heating plate 10 while being oriented with their north pole toward the outside. The magnets thus form means for magnetically suspending each heating plate 9, 10 with respect to the frame 17.

The pressure forces exerted by the heating plates of the invention on the lock of hair wound around the central winding body are preferably between 30 g and 200 g per plate. During tests performed in the laboratory, it was observed that these forces make it possible to guarantee sufficient contact to obtain a good heat transfer in the direction of the treated lock of hair, while limiting the force required to unwind the lock of hair.

In a variant, it is envisaged that these forces be adjusted as a function of the characteristics of the hair, its initial and target temperatures, etc. To do this, it is possible, for example, to integrate the magnets 24 into the bolts, which could then be moved inside threaded housings of the arms 22, 23 to vary their distance from the opposing magnets 25.

Each heating plate 9, 10 includes, inside a body 26, 27, an electric heating element 30, preferably a PTC heating element, and a temperature sensor 31, for example an NTC sensor. The front or feeding part of the body 26, 27 comprises a chamfer 28, 29 for feeding the hair into the appliance.

The winding body 3 includes an electric heating element 33, preferably of the PTC type, and an associated temperature sensor, for example of the NTC type (not shown). The heating element 33 is immovably mounted with respect to the main body 1 of the appliance and it receives the energy through leads connected to those of the general power cables of the appliance, which arrive in the handle 2.

As seen more clearly in FIG. 3, where the clip 7 of FIG. 1, located on the near end of the handle of the winding body 3, has been removed for greater clarity, the winding body 3 includes an external tube 35 rotatably mounted around the longitudinal axis of the appliance. The external tube 35 includes a pointed cap 34 with a rounded end forming the closed front end of the tube 35. The tube 35 also includes a toothed rear end 36 which meshes with the internal teeth of a ring 37. The ring 37 receives the rotational movement of a pinion 38 and a wheel 39 integral with the output shaft of a geared motor assembly 40 comprising a motor 41.

The external tube 35 has a shape that is cylindrical, or preferably slightly conical, on the outside, the angle of inclination of its generatrix being for example between 0° (cylindrical body) and 3°, its internal surface being cylindrical and having an internal diameter smaller than the external diameter of the heating element 33.

The geared motor assembly 40 as well as an electronic microprocessor card 43 and all of the electrical connections are contained in the handle 2 in order to better balance the masses inside the device.

In the examples illustrated in the figures, the internal surfaces of the heating plates 9, 19 have radii of curvature that are homothetic to those of the winding body. Their bodies 26, 27, as well as the external tube 35 of the winding body 3, are made of a material having good heat conductivity properties, for example aluminum, copper, stainless steel, etc. The internal surfaces 11, 12 of the plates 9, 10 and the external surface 5 of the winding body 3 are polished or covered with a coating having a low friction coefficient in order to guarantee a good sliding of the hair during the winding or unwinding of the lock of hair shaped by the device.

The device includes means for regulating the temperature of the heating plates, for example within a range between 160° C. and 220° C., each plate being able to be independently temperature-regulated. The heating temperature of the winding body 3 can also be regulated within a range of 140° C. to 220° C. This makes it possible to adapt the power of the appliance as a function of the load applied, which is itself a function of the mass of the lock of hair, its initial temperature, the target temperature, the tensile stresses that contribute to the heat transfer between the various layers, and the physical characteristics of the materials of the heating parts, as well as those of the hair to be treated.

In operation, the user begins by turning on the appliance, which then initiates the heating of the winding body 3 and the heating plates 9, 10 to the temperature possibly set previously by the user. A light indicator can signal that the heating phase is finished. The user then grasps a lock of hair and inserts the end of it through one of the chamfers 28, 29, sliding it as far as the clip 7, which rises to hook the lock of hair and returns into position due to its elasticity. Once the end of the lock of hair is attached to the winding body 3, the user actuates the toggle button 8, for example by pressing on its upper part, and starts the motor 41 in the clockwise direction. The winding body 3 rotates and the lock of hair is wound up to its root. When the lock of hair is completely wound, the control means of the appliance automatically cut off the power supply to the motor. The user then waits a few moments to give the lock of hair time to reach the right temperature, then actuates the button 8 by pressing on its lower part, thus producing a rotational movement of the motor 41 in the opposite direction, which causes the lock of hair to begin to unwind so that it can be extracted by simply sliding it along the winding body 3.

In the variant of embodiment of the appliance of the invention, as illustrated in FIGS. 4*a* and 4*b*, the heating plates 9, 10 are float mounted as described above with respect to their respective supporting arms 22, 23, but each arm is pivotably mounted to the end of the handle 2, preferably under the thrust of a spring (not shown in the drawings). Thus, the upper arm 22 is pivotably mounted around a pivot axis 45 and the lower arm 23 is pivotably mounted with respect to a pivot axis 46, the axes 45, 46 being parallel to each other and perpendicular to the longitudinal axis "a" of the cylindrically shaped winding body 3. The hooking clip 7 is disposed in this embodiment at the front end of the winding body 3. A button 4 makes it possible to adjust the rotation speed of the winding body 3 and a button 6 makes it possible to regulate its temperature, the appliance being supplied with power by the cord 47.

In operation, the user hooks the end of the lock of hair with the clip 7 and initiates the rotation of the winding body 3 using the button 8, pre-selecting the winding direction (in the direction indicated by arrows in FIG. 4*a*). The winding body 3 rotates and winds the lock of hair. When the lock of hair is completely wound, the user presses on the arms 22, 23 to close the appliance and bring it into the position illustrated in FIG. 4*b*; the heating plates 9, 10 thus shape the hair from the outside, while the winding body 3 shapes it from the inside. Once the shaping is finished, as indicated by a light and sound indicator, the user releases the pressure on the arms 22, 23, which are automatically opened by being pushed by their respective springs.

In a variant not illustrated in the drawings, the heating plates 9, 10 are spring-mounted with respect to their arms 22, 23.

Other variants and embodiments of the invention can be envisaged without going outside the scope of its claims.

The invention claimed is:

1. Hairstyling appliance comprising; a main body (1) having a grasping means (2), a winding body (3) having a longitudinal axis for winding a lock of hair around said longitudinal axis, the winding body containing an electric heating element and comprising an external hair-winding surface (5) extending along substantially its entire length, a clip (7) for hooking the lock of hair onto the winding body (3) and an electric motor for driving the winding body in rotation around its longitudinal axis, characterized in that it includes at least one heating plate (9, 10) disposed facing the external surface (5) of the winding body (3), which plate is movably mounted with respect to the winding body so as to exert pressure on the lock of hair, wherein said winding body has a conical shape from a base that joins said winding body to said main body to an opposite end of said winding body.

2. Appliance according to claim 1, characterized in that said appliance includes two heating plates (9, 10) disposed on either side of the longitudinal axis of the winding body (3).

3. Appliance according to claim 1, characterized in that the internal surface (11, 12) of the heating plates (9, 10) has a concave shape.

4. Appliance according to claim 1, characterized in that the winding body (3) has a shape generated by rotation and that, in the same cross-section of the appliance, the radius of curvature of the heating plate (9, 10) is equal to or larger than that of the winding body (3).

5. Appliance according to claim 2, characterized in that each heating plate (9, 10) includes an electric heating element and means for regulating its temperature.

6. Appliance according to claim 5, characterized in that said appliance comprises means for controlling the temperature of the heating element of the winding body and means for controlling the temperature of the heating elements of the heating plates.

7. Appliance according to claim 1, characterized in that the radius of the base larger than that of the opposite end.

8. Appliance according to claim 1, characterized in that the winding body is driven in rotation by a geared motor at a speed between 5 and 30 rpm.

9. Appliance according to claim 1, characterized in that said appliance comprises means for limiting the torque of the motor.

10. Appliance according to claim 9, characterized in that said means for limiting the torque comprise a microprocessor capable of monitoring the current absorbed by the geared motor and of cutting off its power supply if a threshold limit is exceeded.

11. Appliance according to claim 1, characterized in that said appliance comprises means for controlling the direction of rotation of the winding body.

12. Appliance according to claim 2, characterized in that the external surface of the winding body and the internal surface of the heating plates are polished or covered with a coating with a low friction coefficient.

13. Hairstyling appliance comprising; a main body (1) having a grasping means (2), a winding body (3) having a longitudinal axis for winding a lock of hair around said longitudinal axis, the winding body containing an electric heating element and comprising an external hair-winding surface (5) extending along substantially its entire length, a clip (7) for hooking the lock of hair onto the winding body (3) and an electric motor for driving the winding body in rotation around its longitudinal axis, characterized in that it includes at least one heating plate (9, 10) disposed facing the external surface (5) of the winding body (3), which plate is movably mounted with respect to the winding body so as to exert pressure on the lock of hair, characterized in that said appliance includes: a frame immovably mounted on the main body of the appliance; and two heating plates (9, 10) disposed on either side of the longitudinal axis of the winding body (3), and the heating plates are enclosed by the frame and are mounted so as to be capable of moving radially.

14. Appliance according to claim 13, characterized in that said heating plates are float mounted using means for suspending them with respect to said frame.

15. Appliance according to claim 14, characterized in that the means for suspending each plate comprise at least one pair of opposing magnets mounted in phase with each other.

16. Appliance according to claim 14, characterized in that it comprises means for adjusting the force of said means for suspending.

17. Hairstyling appliance comprising; a main body (1) having a grasping means (2), a winding body (3) having a longitudinal axis for winding a lock of hair around said longitudinal axis, the winding body containing an electric heating element and comprising an external hair-winding surface (5) extending along substantially its entire length, a clip (7) for hooking the lock of hair onto the winding body (3) and an electric motor for driving the winding body in rotation around its longitudinal axis, characterized in that it includes at least one heating plate (9, 10) disposed facing the external surface (5) of the winding body (3), which plate is movably mounted with respect to the winding body so as to exert pressure on the lock of hair, characterized in that: aid appliance includes two heating plates (9, 10) disposed on either side of the longitudinal axis of the winding body (3); each heating plate (9, 10) includes an electric heating element and means for regulating its temperature; said appliance comprises means for controlling the temperature of the heating element of the winding body and means for controlling the temperature of the heating elements of the heating plates; and said appliance comprises; a support; and means for adjusting the distance between a heating plate and said support.

18. Hairstyling appliance comprising; a main body (1) having a grasping means (2), a winding body (3) having a longitudinal axis for winding a lock of hair around said longitudinal axis, the winding body containing an electric heating element and comprising an external hair-winding surface (5) extending along substantially its entire length, a clip (7) for hooking the lock of hair onto the winding body (3) and an electric motor for driving the winding body in rotation around its longitudinal axis, characterized in that it includes two heating plates (9, 10) disposed facing the external surface (5) of the winding body (3), on opposite sides of the winding body which plates are movably mounted with respect to the winding body so as to exert pressure on the lock of hair, characterized in that the winding body comprises, on the inside, a heating element immovably mounted to the main body of the appliance, and on the outside, a tube rotatably mounted around the longitudinal axis of the winding body.

* * * * *